US009498093B2

(12) United States Patent
Todd

(10) Patent No.: US 9,498,093 B2
(45) Date of Patent: Nov. 22, 2016

(54) SOAP HOLDING BATHING ASSISTANCE DEVICE

(71) Applicant: Joshua Todd, Boaz, AL (US)

(72) Inventor: Joshua Todd, Boaz, AL (US)

(73) Assignee: Joshua Chad Todd, Boaz, AL (US)

( * ) Notice: Subject to any disclaimer, the term of this patent is extended or adjusted under 35 U.S.C. 154(b) by 154 days.

(21) Appl. No.: 14/490,078

(22) Filed: Sep. 18, 2014

(65) Prior Publication Data

US 2016/0081518 A1 Mar. 24, 2016

(51) Int. Cl.

| | |
|---|---|
| ***A47K 7/03*** | (2006.01) |
| ***A47K 5/03*** | (2006.01) |
| *A47K 5/12* | (2006.01) |

(52) U.S. Cl.
CPC . *A47K 7/03* (2013.01); *A47K 5/03* (2013.01); *A47K 5/1201* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,143,755 | A * | 8/1964 | Rowley | A47K 7/03 222/173 |
| 4,457,640 | A * | 7/1984 | Anderson | A47K 7/03 15/104.94 |
| 4,969,225 | A | 11/1990 | Schubert | |
| 5,022,517 | A * | 6/1991 | Benitez | A47K 7/03 15/209.1 |
| 5,031,759 | A | 7/1991 | Ogilvie | |
| 5,326,610 | A | 7/1994 | Moss | |
| 5,486,064 | A | 1/1996 | Schulte | |
| 5,704,723 | A * | 1/1998 | Salisian | A47K 7/03 401/201 |
| D392,433 | S | 3/1998 | Norris | |
| 5,857,794 | A | 1/1999 | Chien | |
| 6,318,922 | B1 * | 11/2001 | Briggs | A47K 7/03 206/77.1 |
| 7,473,044 | B2 * | 1/2009 | Collins | A47K 5/08 401/201 |
| 9,044,121 | B2 * | 6/2015 | Phillips | A47K 7/02 |
| 2007/0065224 | A1 | 3/2007 | Shaw | |

* cited by examiner

*Primary Examiner* — David Walczak

(57) ABSTRACT

A soap holding bathing assistance device for holds and dispenses soap from a container usable to scrub a person when bathing includes a container having a closed end and a peripheral wall extending from the closed end defining an interior space of the container. The container has an open end opposite the closed end wherein the container is configured for receiving soap into the interior space of the container. The container is constructed of an absorptive material wherein the container is configured for applying soap to a bather. An exterior surface of the container is abrasive wherein the container is configured for removing dead skin as the container is used to apply soap to the bather. A closure inhibits the soap from passing through the open end of the container.

10 Claims, 8 Drawing Sheets

SOAP HOLDING BATHING ASSISTANCE DEVICE

BACKGROUND OF THE DISCLOSURE

Field of the Disclosure

The disclosure relates to bathing assistance devices and more particularly pertains to a new bathing assistance device for holds and dispenses soap from a container usable to scrub a person when bathing.

SUMMARY OF THE DISCLOSURE

An embodiment of the disclosure meets the needs presented above by generally comprising a container having a closed end and a peripheral wall extending from the closed end defining an interior space of the container. The container has an open end opposite the closed end wherein the container is configured for receiving soap into the interior space of the container. The container is constructed of an absorptive material wherein the container is configured for applying soap to a bather. An exterior surface of the container is abrasive wherein the container is configured for removing dead skin as the container is used to apply soap to the bather. A closure inhibits the soap from passing through the open end of the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
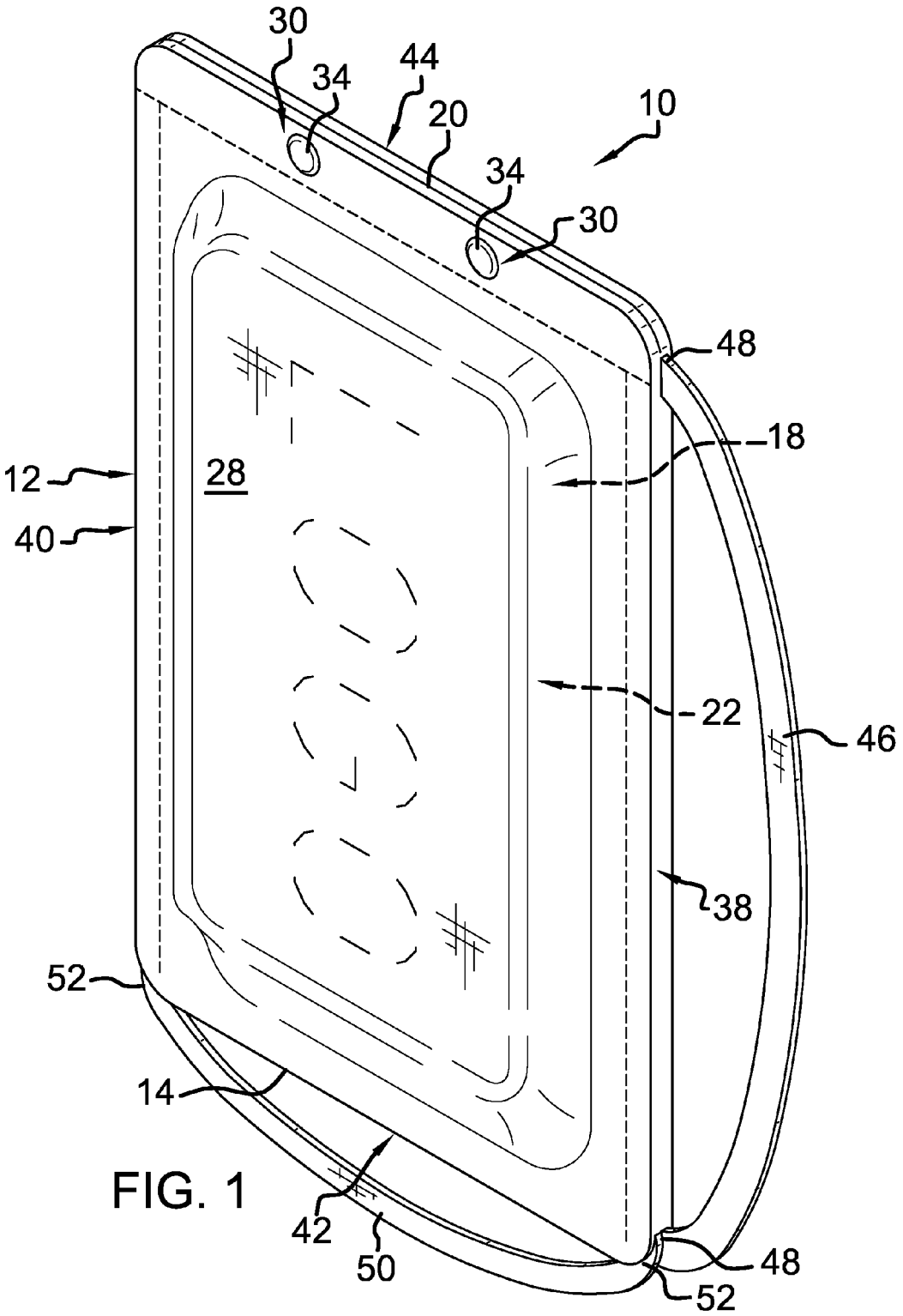
FIG. 1 is a top front side perspective view of a soap holding bathing assistance device according to an embodiment of the disclosure.
Figure 2:
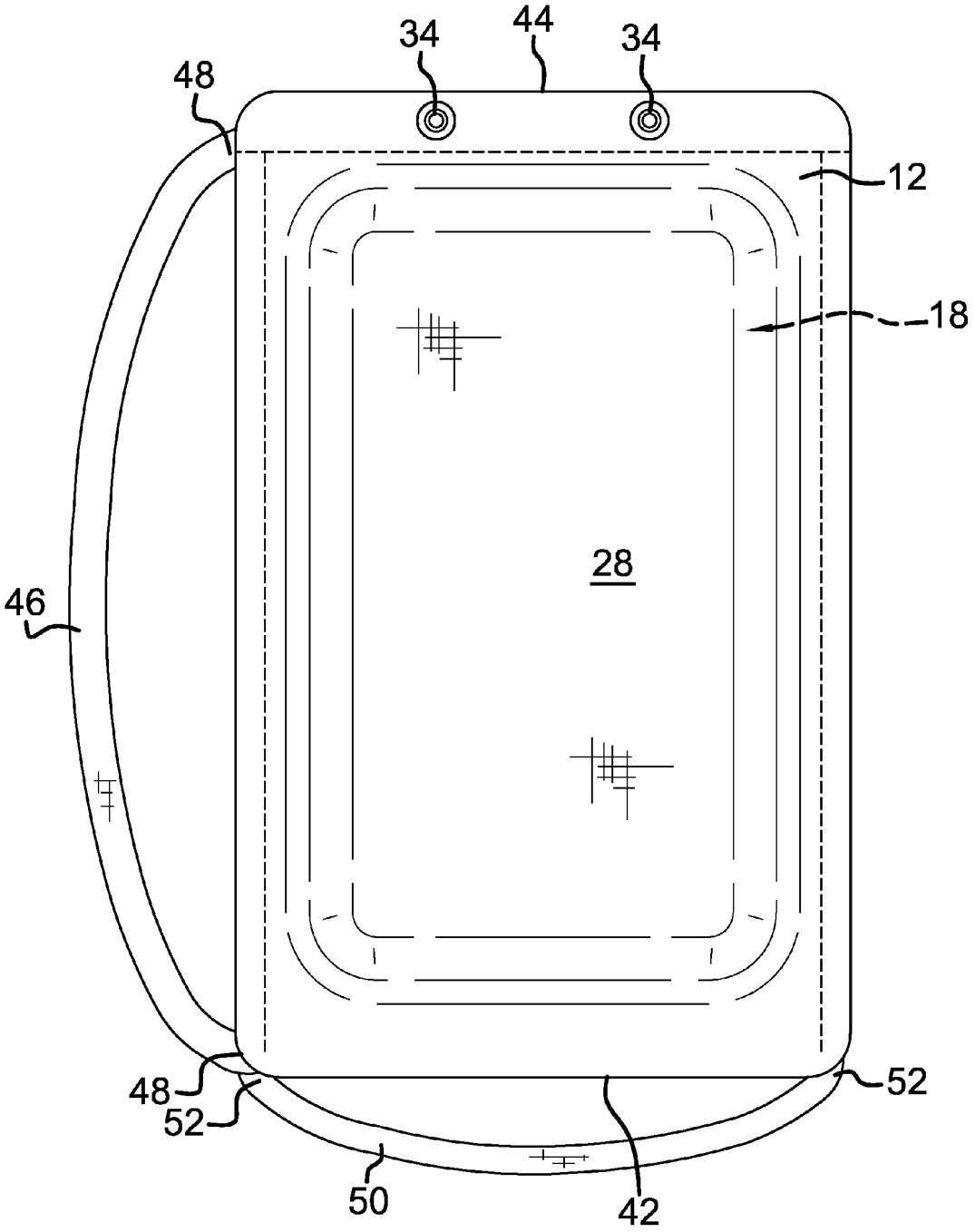
FIG. 2 is a back view of an embodiment of the disclosure.
Figure 3:
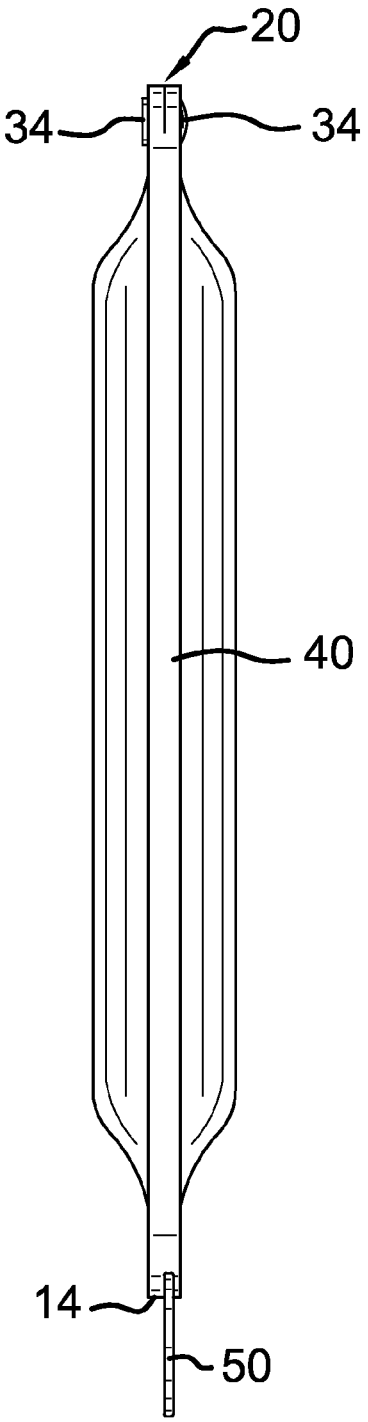
FIG. 3 is a side view of an embodiment of the disclosure.
Figure 4:
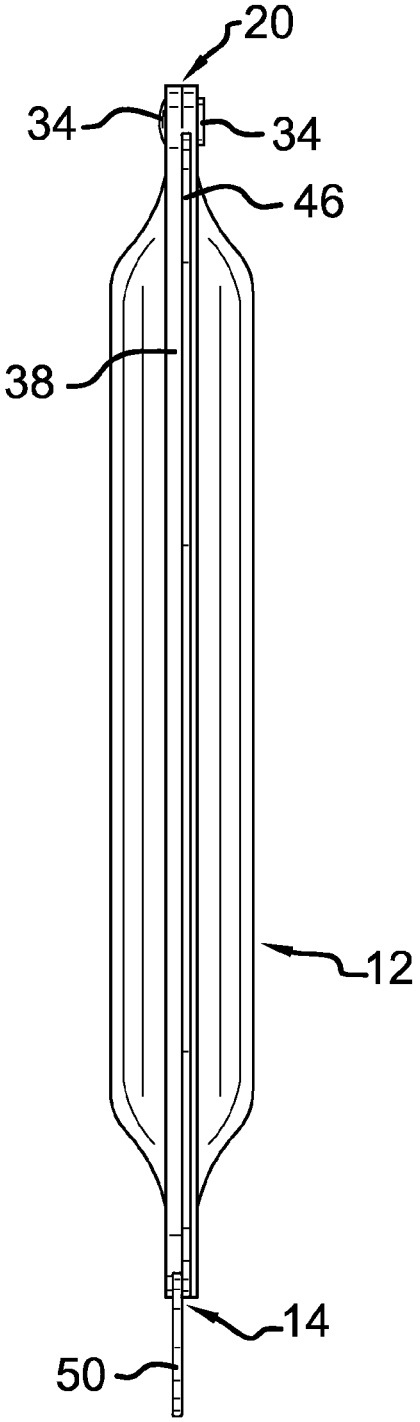
FIG. 4 is a side view of an embodiment of the disclosure.
Figure 5:
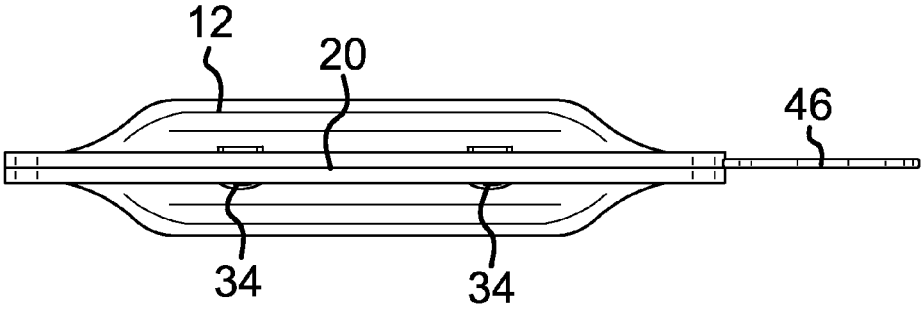
FIG. 5 is a top view of an embodiment of the disclosure.
Figure 6:
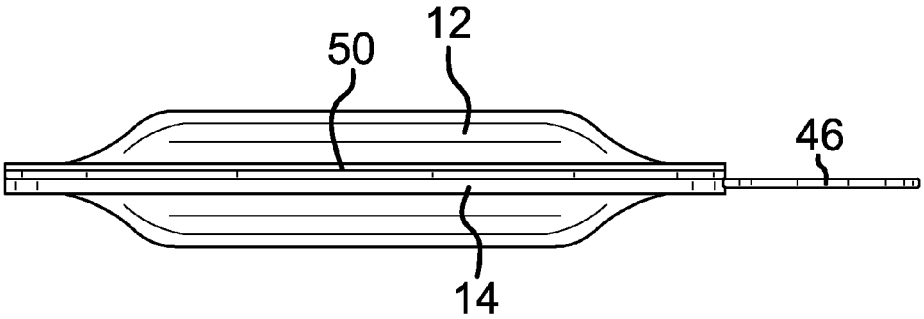
FIG. 6 is a bottom view of an embodiment of the disclosure.

With reference now to the drawings, and in particular to FIGS. 1 through 10 thereof, a new bathing assistance device embodying the principles and concepts of an embodiment of the disclosure and generally designated by the reference numeral 10 will be described.

As best illustrated in FIGS. 1 through 10, the soap holding bathing assistance device 10 generally comprises a container 12 having a closed end 14 and a peripheral wall 16 extending from the closed end 14 defining an interior space 18 of the container 12.

The container 12 has an open end 20 opposite the closed end 14 wherein the container 12 is configured for receiving soap 22 into the interior space 18 of the container 12. As discussed below, the soap 22 may be in the form of a bar 24 or a liquid 26 held in a vessel 32. The container 12 is constructed of an absorptive material such as fabric, interwoven fibers, or the like, wherein the container 12 is configured for applying the soap 22 to a bather. An exterior surface 28 of the container 12 is abrasive in the manner of conventional bath scrubbing devices wherein the container 12 is configured for removing dead skin as the container 12 is used to apply the soap 22 to the bather. A closure 30 is coupled to the container 12. The closure 30 selectively closes the open end 20 of the container 12 wherein the closure 30 is configured for inhibiting the soap 22 from passing through the open end 20 of the container 12. The closure 30 may comprise a pair of spaced snaps 34. Alternatively, the closure 30 may be a drawstring 36 extending through the container 12 around the open end 20.

Figure 7:
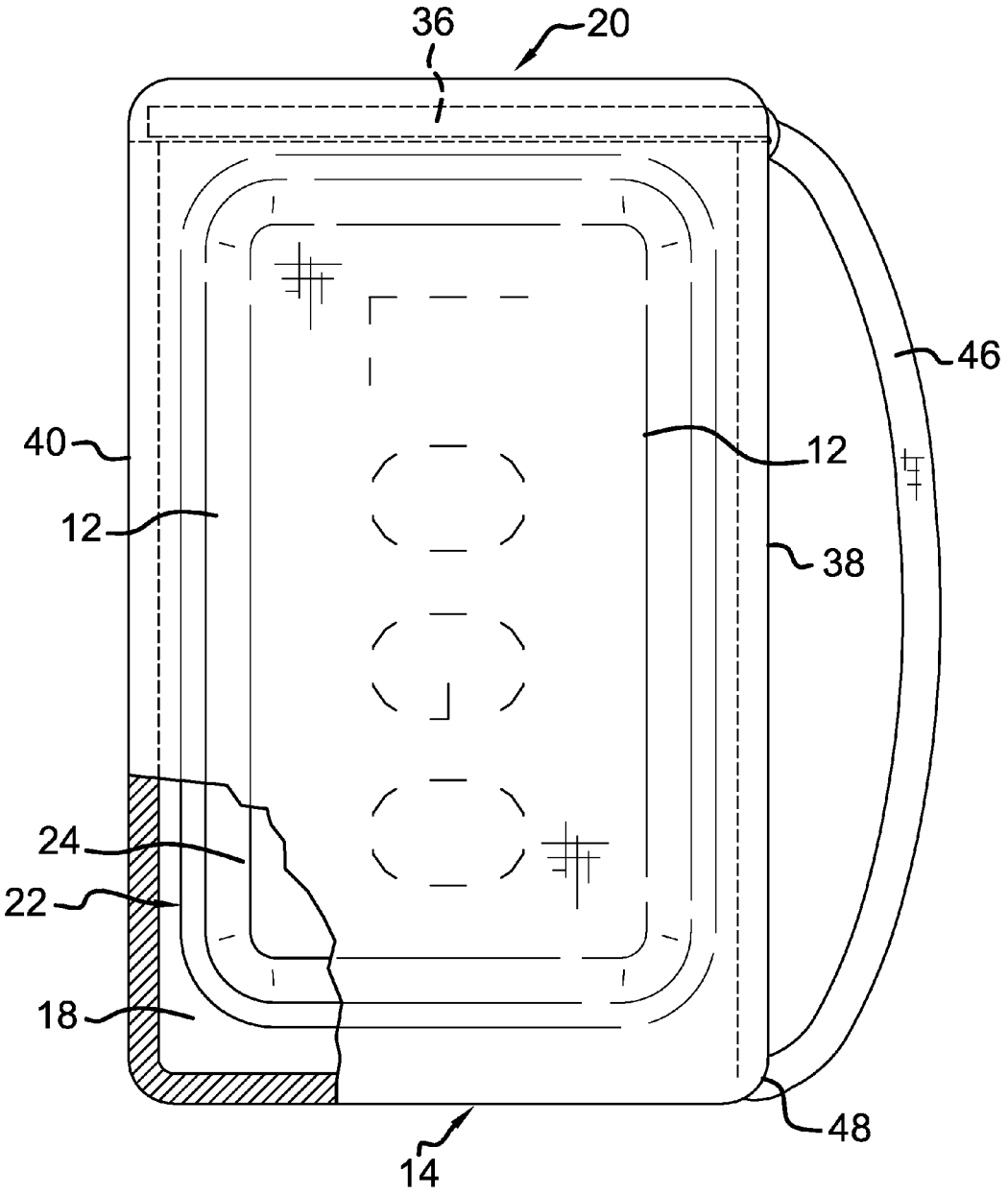
FIG. 7 is a front view of an embodiment of the disclosure.
Figure 8:
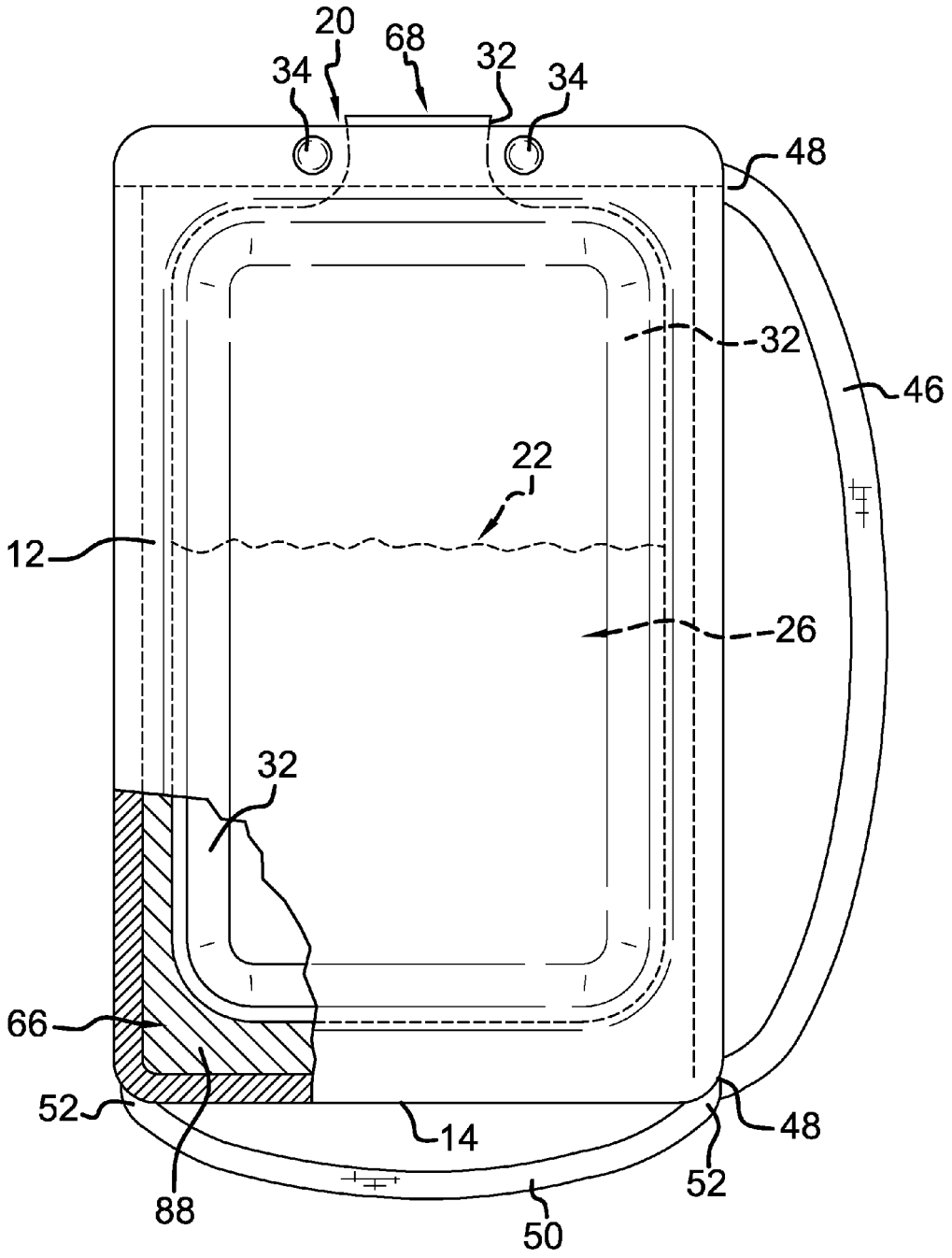
FIG. 8 is a front view of an embodiment of the disclosure.
Figure 9:
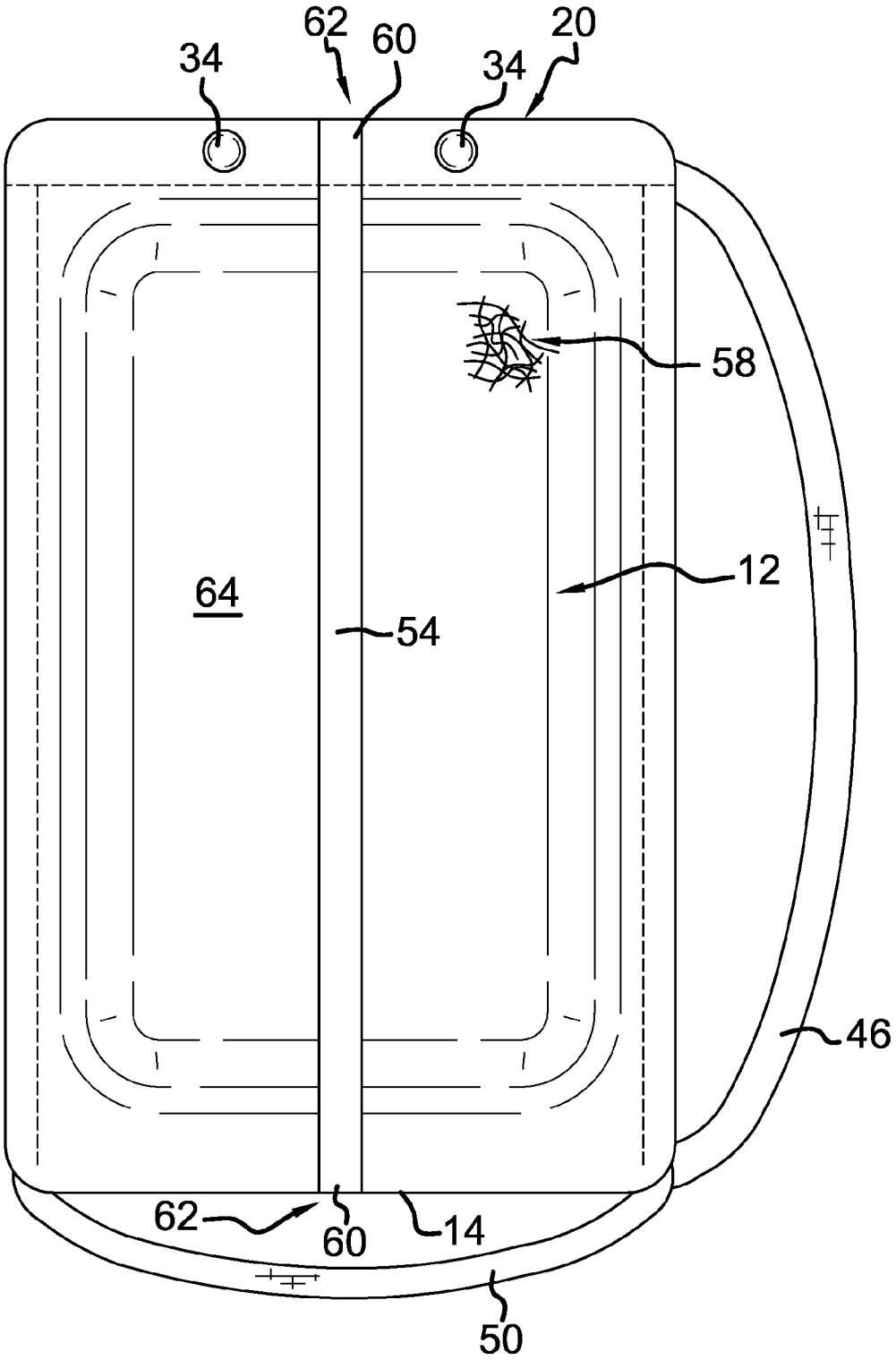
FIG. 9 is a front view of an embodiment of the disclosure.
Figure 10:
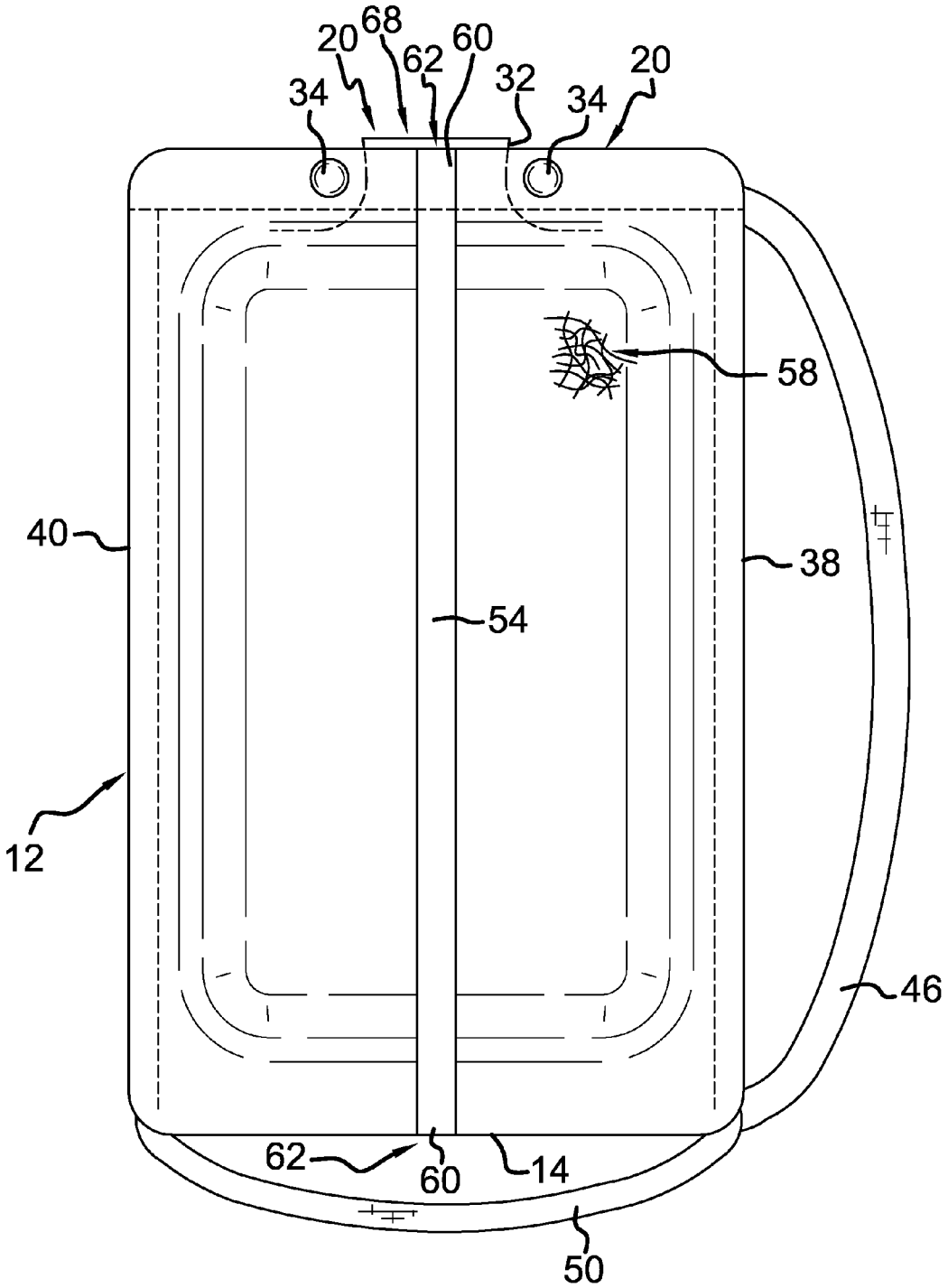
FIG. 10 is a front view of an embodiment of the disclosure.

The container 12 has a pair of longitudinal sides 38,40 and a pair of short sides 42,44. The closed end 14 of the container 12 is a first one of the short sides 42 and the open end 20 of the container 12 is a second one of the short sides 44. A side strap 46 has opposite ends 48 coupled to the container 12 such that the side strap 46 extends along one of the longitudinal sides 38 of the container 12. The drawstring 36 may be incorporated into the side strap 46 as shown in FIG. 7.

An end strap 50 may be provided. The end strap 50 has opposite ends 52 coupled to the container 12 such that the end strap 50 extends along the first one of the short sides 42 such that the end strap 50 extends along the closed end 14 of the container 12.

A center strap 54 may be coupled to the container 12, particularly in an embodiment in which the container 12 is constructed of a loofah material 58. The center strap 54 has opposite ends 60 coupled to respective medial points 62 of the short sides 42,44 of the container 12 wherein the center strap 54 extends between the short sides 42,44 of the container 12 along a face 64 of the container 12. The center strap 54 is parallel to the longitudinal sides 38,40 of the container 12.

A liner 66 is positioned in the interior space 18 of the container 12 and may be coupled to the container 12, particularly when the soap 22 is the liquid 26 contained in the vessel 32. The liner 66 may be a sponge 88 or other cushioning material wherein contact with the vessel 32 through the container 12 is cushioned. The vessel 32 is positioned in the interior space 18. The vessel 32 is fluid impermeable wherein the vessel 32 is configured for holding the soap 22 in a liquid form within the interior space 18. The vessel 32 comprises a dispensing opening 68. The dispensing opening 68 is positioned along the open end 20 of the container 12 when the vessel 32 is positioned in the interior space 18. The vessel 32 may be a squeeze bottle wherein the vessel 32 is configured for dispensing the soap 22 in liquid form through the dispensing opening 68 when the container 12 is squeezed.

In use, the soap 22 is dispensed through the container 12 itself when the soap 22 is in the bar form within the interior space 18. Otherwise, the soap 22 is dispensed from the vessel 32 and may be applied to the container 12 allowing the container 12 to be used to apply the soap 22 and scrub a bather's body.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A soap holding bathing assistance device comprising:

a container having a closed end and a peripheral wall extending from said closed end defining an interior space of said container, said container having an open end opposite said closed end wherein said container is configured for receiving soap into said interior space of said container, said container being constructed of an absorptive material wherein said container is configured for applying soap to a bather;

an exterior surface of said container being abrasive wherein said container is configured for removing dead skin as said container is used to apply soap to the bather;

a closure coupled to said container, said closure selectively closing said open end of said container wherein said closure is configured for inhibiting the soap from passing through said open end of said container;

a liner positioned in said interior space of said container, said liner being sponge; and a vessel positioned in said interior space, said interior vessel being fluid impermeable wherein said interior vessel is configured for holding the soap in a liquid form within said interior space, said vessel comprising a dispensing opening, said dispensing opening being positioned along said open end of said container when said vessel is positioned in said interior space, said vessel being a squeeze bottle wherein said vessel is configured for dispensing the soap in liquid form through said dispensing opening when said container is squeezed.

2. The device of claim 1, further comprising said container having a pair of longitudinal sides and a pair of short sides, said closed end of said container being a first one of said short sides, said open end of said container being a second one of said short sides.

3. The device of claim 2, further comprising a side strap having opposite ends coupled to said container such that said side strap extends along one of said longitudinal sides of said container.

4. The device of claim 2, further comprising an end strap, said end strap having opposite ends coupled to said container such that said end strap extends along one of said short sides.

5. The device of claim 4, further comprising said end strap extending along said closed end of said container.

6. The device of claim 2, further comprising a center strap coupled to said container, said center strap having opposite ends coupled to respective medial points of said short sides of said container wherein said center strap extends between said short sides of said container along a face of said container.

7. The device of claim 6, further comprising said center strap being parallel to said longitudinal sides of said container.

8. The device of claim 1, further comprising said closure being a pair of spaced snaps.

9. The device of claim 1, further comprising:

a center strap coupled to said container, said center strap having opposite ends coupled to respective medial points of said short sides of said container wherein said center strap extends between said short sides of said container along a face of said container, said center strap being parallel to said longitudinal sides of said container; and said container being constructed of a loofah material.

10. A soap holding bathing assistance device comprising:

a container having a closed end and a peripheral wall extending from said closed end defining an interior space of said container, said container having an open end opposite said closed end wherein said container is configured for receiving soap into said interior space of said container, said container being constructed of an absorptive material wherein said container is configured for applying soap to a bather;

an exterior surface of said container being abrasive wherein said container is configured for removing dead skin as said container is used to apply soap to the bather; and a closure coupled to said container, said closure selectively closing said open end of said container wherein said closure is configured for inhibiting the soap from passing through said open end of said container, said closure being a pair of spaced snaps;

said container having a pair of longitudinal sides and a pair of short sides, said closed end of said container being a first one of said short sides, said open end of said container being a second one of said short sides;

a side strap having opposite ends coupled to said container such that said side strap extends along one of said longitudinal sides of said container;

an end strap, said end strap having opposite ends coupled to said container such that said end strap extends along one of said short sides, said end strap extending along said closed end of said container;

a liner positioned in said interior space of said container, said liner being sponge; and a vessel positioned in said interior space, said interior vessel being fluid impermeable wherein said interior vessel is configured for holding the soap in a liquid form within said interior space, said vessel comprising a dispensing opening, said dispensing opening being positioned along said open end of said container when said vessel is positioned in said interior space, said vessel being a squeeze bottle wherein said vessel is configured for dispensing the soap in liquid form through said dispensing opening when said container is squeezed.

* * * * *